United States Patent [19]

Lyon

[11] Patent Number: 4,960,399

[45] Date of Patent: Oct. 2, 1990

[54] DIVER'S UTILITY CONSOLE

[76] Inventor: Richard A. Lyon, 4108 Hidden Canyon Cove, Austin, Tex. 78746

[21] Appl. No.: 219,332

[22] Filed: Jul. 14, 1988

[51] Int. Cl.[5] ..... B63C 11/02

[52] U.S. Cl. ..... 441/136; 383/12; 383/33; 405/186

[58] Field of Search ..... 405/185, 186; 114/315; 441/136, 129, 130; 43/55; 383/6, 12, 14, 33, 117

[56] References Cited

U.S. PATENT DOCUMENTS

| | | | |
|---|---|---|---|
| 516,194 | 3/1894 | Freer | 383/12 X |
| 2,420,087 | 11/1943 | Meek | 43/12 |
| 2,725,657 | 3/1954 | Wiederhold | 43/12 |
| 2,865,421 | 12/1958 | Walsh | 383/33 X |
| 2,901,143 | 8/1959 | Pope | 362/154 |
| 2,974,331 | 3/1961 | Dize | 441/130 |
| 3,045,262 | 7/1962 | Mitchell | 441/136 |
| 3,077,693 | 7/1961 | Wallin | 362/109 |
| 3,584,594 | 6/1971 | Poutout | 114/315 |
| 3,747,139 | 7/1973 | Braly | 405/186 |
| 3,777,498 | 12/1973 | Andrews et al. | 383/33 X |
| 3,938,132 | 2/1976 | Cunningham | 362/154 |
| 3,988,853 | 11/1976 | Hudkins | 43/55 |
| 4,060,929 | 12/1977 | Meyer et al. | 46/11 |
| 4,156,446 | 5/1979 | Nathan | 383/6 |
| 4,518,364 | 5/1985 | Jacobson | 441/129 |

*Primary Examiner*—Sherman D. Basinger
*Attorney, Agent, or Firm*—Thomas J. Tighe

[57] ABSTRACT

A hand-portable console device for use by underwater divers. A housing having at least a forward, water-vented storage compartment adapted to have an external illumination mounted thereon. The housing can also have an aft compartment. Attachment to the housing is a collapsible game bag. A bladder inflatable from a diver's air tank can be fitted inside the game bag to make a floatation device. Affixed or integral with the housing are ambient water parameter indicators, e.g., depth, temperature. The housing can also have a writing surface to enable divers to communicate with each other by writing messages on said surface.

13 Claims, 3 Drawing Sheets

DIVER'S UTILITY CONSOLE

BACKGROUND OF THE INVENTION

This invention relates in general to hand-held storage and external illumination equipment used in the course of underwater diving, and in particular to such equipment which provides ambient water parameters such as depth and temperature, and a directional reference.

Heretofore there has not been available to a diver a universal diving console as presented by this invention which may be held by either hand, is negatively buoyant, and is normally positioned slightly forward and below a swimming diver. Such an orientation permits easy utilization of the advantageous features of the console, such as an external illumination means, a writing means for communication with fellow divers and/or for written reminders, a mirror, a compass and ambient parametric information devices such as a depth gauge and a thermometer. A rope lanyard with clip is provided to secure the console to the diver's weight belt during times when freedom of both hands is desired. The console also provides a detachable subassembly containing a mesh bag for holding game or objects collected during a dive. The mesh bag subassembly can be held separately by a stowable handle or re-attached to the console. The mesh bag subassembly is also adapted to have inserted therein an air-tight plastic liner in the form of a bladder to convert it to a lift or floatation device. The removeable liner is normally stored in a console compartment. When a light is not desired, the compartment of the console in which the light is normally mounted can be used for vented storage of game and collected objects.

Other advantages and attributes of this invention will be readily discernible upon the reading of the text hereinafter.

SUMMARY OF THE INVENTION

This invention in its fullest form presents a housing of generally rectangular parallelepiped form having a forward compartment, an aft compartment, a detachable game bag means and/or floatation means, a writing slate, a rear view mirror, a directional reference such as a compass, and parametric informational devices such as temperature and depth gauge means. The forward compartment is used as a utility chamber with its forward end closed by a grate, or it mounts a sealed beam light as an external illumination means. The aft compartment is used as an additional utility chamber.

An object of this invention is to provide a negatively buoyant, hand-portable diving console which provides a diver with an optional illumination means, unfoldable storage capacity for game and collected objects, integral storage capacity, parametric information, and a directional reference.

A further object of this invention to provide a negatively buoyant, hand-portable diving console as described in the preceding paragraph packaged in a single, compact unit adapted to be tethered to a diver.

Other objects of this invention will be readily discernible upon reading of the text hereinafter.

DESCRIPTION OF THE PREFERRED EMBODIMENT

Figure 1:
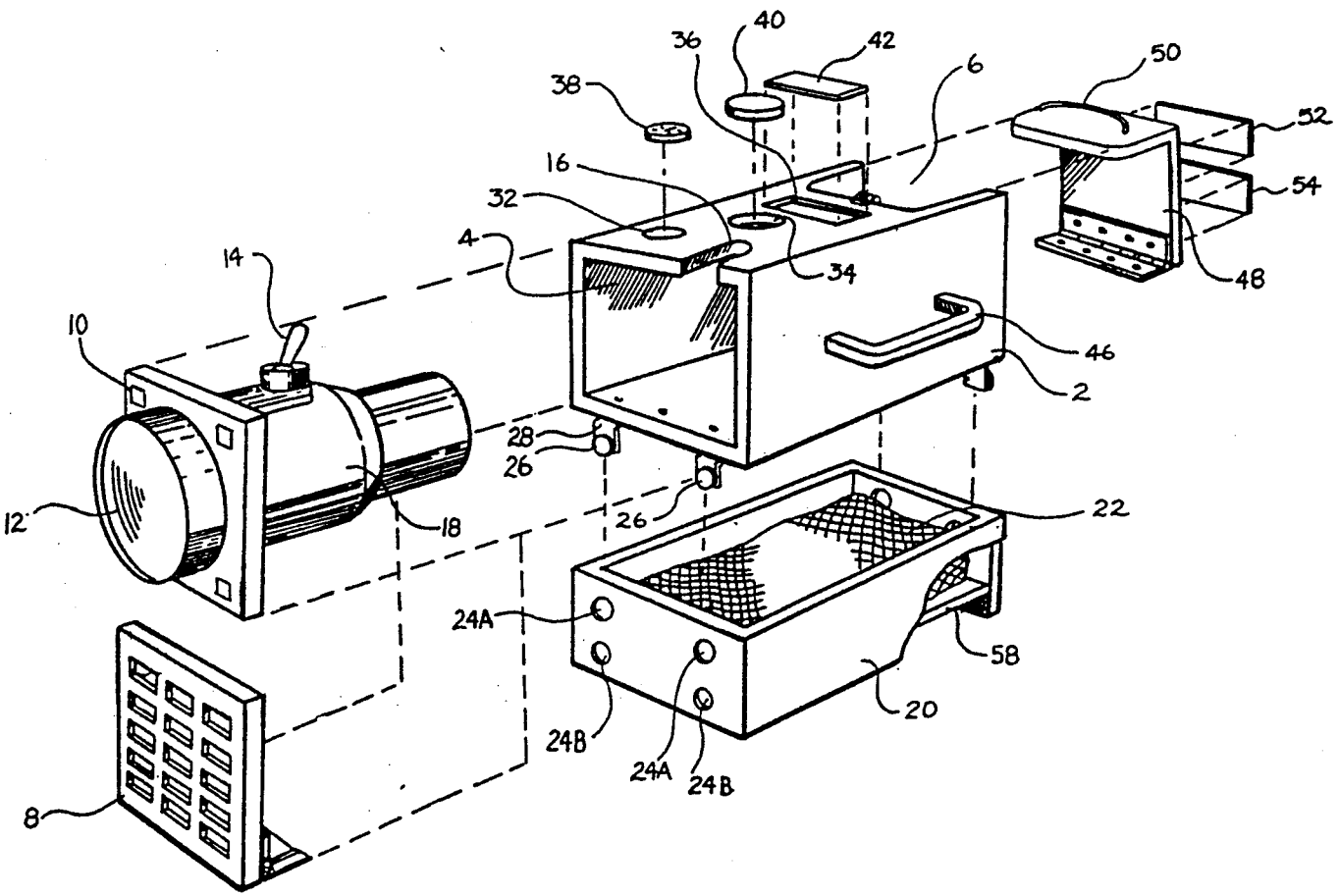
FIG. 1 is an exploded view of this invention showing the forward compartment as alternately a storage chamber and an external light mounting means.

Referring to FIG. 1 a generally rectangular parallelepiped housing 2 is shown to define a forward compartment 4 and an aft compartment 6. The forward compartment 4 is optionally closed by a grate 8 by which it becomes a storage chamber, that is, a chamber which can contain other desireable implements or equipment. The grate 8 allows water to enter the chamber to prevent unwanted buoyancy due to captured air. The grate also permits the forward compartment to contain game or objects collected under water.

Referring again to FIG. 1, the forward compartment can also mount an external illumination means. In such cases it is closed by a flange 10 of a light subassembly 18 having a sealed beam light 12 energizable by a switch 14. A slot 16 defined by a top of the housing 2 is adapted to permit the switch 14 to be disposed therein and protrude through the housing and in order to be accessable to a user when the flange 10 abuts the forward end of the housing 2. The light battery (not shown) is disposed within the subassembly 18.

Referring again to FIG. 1, a game bag means is shown to comprise a generally rectangular opened-top enclosure 20 in which is disposed a folder or collapsed mesh game bag 22. The enclosure 20 is attachable and detachable to a base of the housing 2 by means of a plurality of tabs 26 and socket means 24A and 24B. The forward and aft ends of the enclosure define a plurality of upper sockets 24A and lower sockets 24B which are adapted to engage with, one each, the plurality of tabs 26 projecting from the base of the housing 2 by resiliently flexible shanks 28.

Referring again to FIG. 1, the top of the housing 2 defines recesses 32, 34 and 36 in which are disposed a directional reference such as a compass 38, a water temperature indicator 40, and writing surface 42, respectively. The housing also has a pair of handle grips 46 laterally projecting from its sides.

The aft compartment 6 of the housing 2 is closeable by a hinged and right-angled door 48, the door being operable by a latch. On the aft side of the rear door 48 are affixed a rear view mirror 52 and a writing slate 54 adapted to be written upon under water. Atop the door 48 is a capillary depth gauge 50.

Figure 3:
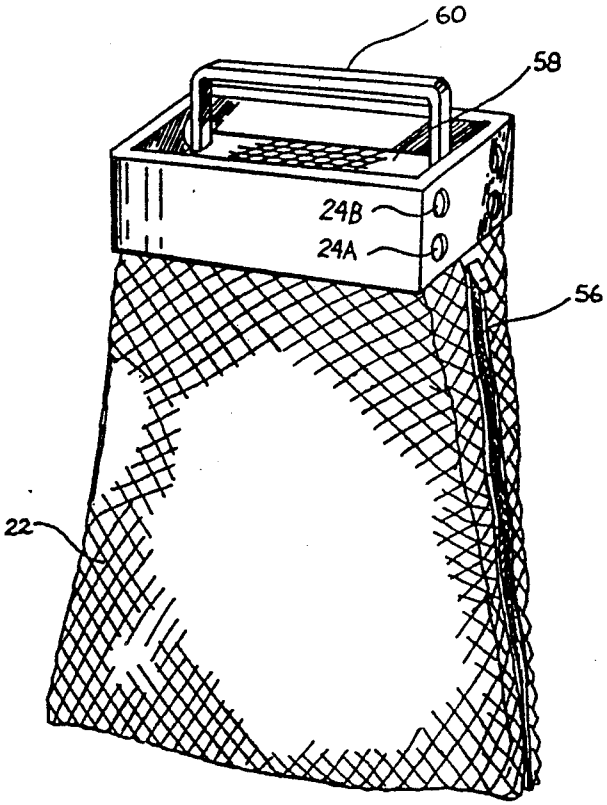
FIG. 3 is a perspective view of the detachable game bags and floatation means.
Figure 2:
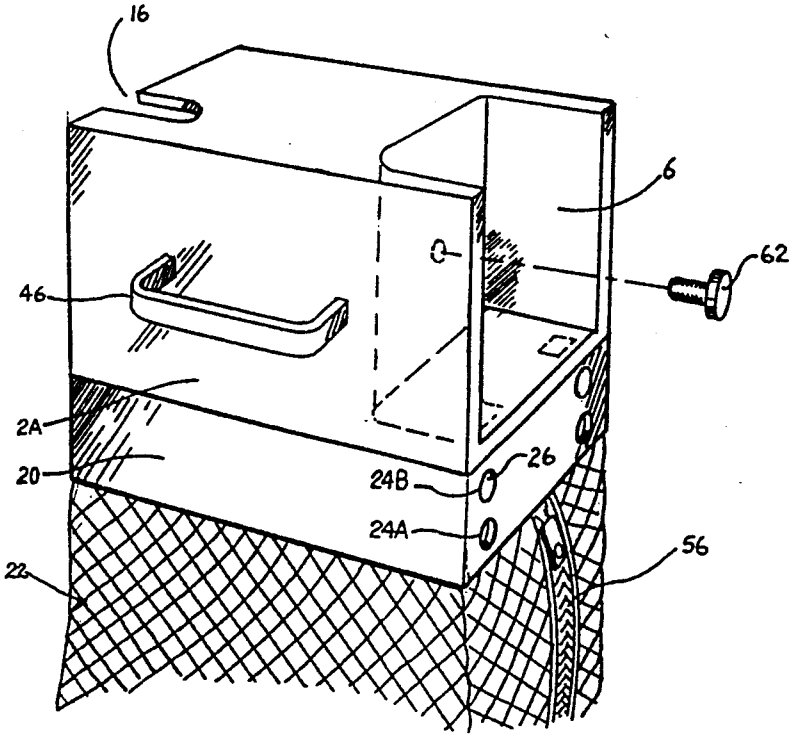
FIG. 2 is a perspective view of the rear of the housing with the aft compartment open.

Referring to FIGS. 2 and 3, the game bag enclosure 20 is upside-down from its first orientation in FIG. 1. Note that in FIG. 1 the sockets 24A are above the sockets 24B, whereas is FIGS. 2 and 3 the reverse is true. The first orientation of the enclosure shown in FIG. 1 is for storing a folded or collapsed game bag, whereas the second orientation shown in FIGS. 2 and 3 is for using the game bag for its intended purpose, unfolded and/or uncollapsed. In both orientations the enclosure can be attached to the base of the housing 2 by means of the tabs 26 engaging the sockets 24A in the first orientation or sockets 24B in the second orientation.

Referring again to FIGS. 2 and 3, the game bag 22 is shown in its extended form and is shown to further comprise a side zipper means 56 by which the game is put into and taken out of the bag. A top of the game bag 22 is affixed to a grated plate 58 which extends between and is affixed to the walls of the enclosure 20. When the enclosure 20 is attached to the housing 2 as shown in FIG. 1, the grated plate 58 is a recessed (bottomside) floor of the enclosure such that the enclosure 20 and the grated plate 58 form an open-top container adapted to contain therein the collapsed game bag 22. Also affixed to the walls of the enclosure 20 is a hinged handle grip 60 which is foldable into the bottomside recess. Thus, the game bag means can be carried and used either attached to the housing 2 or independently by means of handle 60.

Referring to FIG. 2, the aft compartment 6 can more clearly be seen sans the aft door 48. A bolt means 62 is seen to project through a wall 64 separating the forward and aft compartments for the purpose of engaging and securing the illumination means in the forward compartment.

Figure 4:
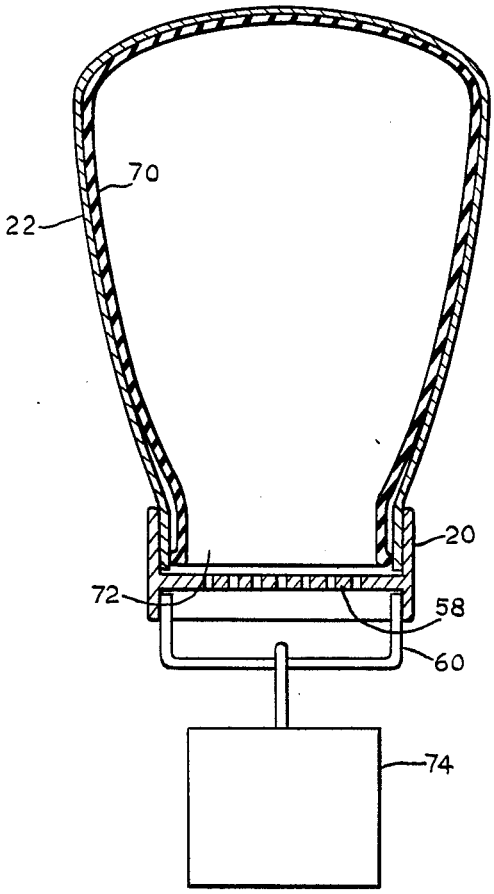
FIG. 4 is a sectional view of a floatation device according to this invention.

Referring to FIG. 4, an air-tight bladder or liner 70 is illustrated as having been inserted into the game bag 22 and filled with air, for example from a diver's air tank, to create a lift or floatation device. The bladder has an opening 72 facing the grated plate 58 so that the bladder can be filled by air rising through the openings in the plate. The air-filled liner trapped in the game bag 22 is a positive buoyancy element and the handle 60 can be used to tie things 74 to the floatation device.

Optionally, the tabs 26 and the sockets 24A and 24B could be replaced by swatches of a hook and loop attaching means.

The foregoing description and drawings were given for illustrative purpose only, it being understood that the invention is not limited to the embodiments disclosed, but is intended to embrace any and all alternatives, equivalents, modifications and rearrangements of elements falling within the scope of the invention as defined by the following claims.

I claim:

1. A hand-portable divers' utility console comprising:
(a) a housing defining at least a water-vented compartment having a removable, forward closure for alternately storing things or mounting an external illumination means when the closure is removed,
(b) a diver's bag device comprising:
(i) a flexible, water-vented sack means, said means being collapsible into a folded state,
(ii) a framework means defining an open-face enclosure having a rim for containing therein the sack means in its collapsed state, the sack means being affixed to the framework in a way that whenever the open face of the enclosure is facing generally downward, the force of gravity will tend to un-collapse the sack means and distend it,
(iii) means for applying a gripping force to the framework in a direction which would oppose any force exerted on the framework by the sack means or its contents,
(iv) a closeable port defined by the sack means for taking things in and out the sack means, and
(c) means for latching the open face of the enclosure against a surface of the housing whenever the sack means is collapsed therein, said surface of the housing substantially closing the enclosure in order to contain the sack means.

2. The device of claim 1 further comprising:
(a) a directional reference means affixed to the housing, and
(b) an underwater writing means for conveying written information to a diver.

3. The device of claim 1 further comprising an aft 2 compartment.

4. The utility console according to claim 1 further comprising means for latching the framework to the housing on a side opposite the open face of the enclosure leaving the enclosure open to allow the sack means to freely extend and distend.

5. The device of claim 4 further comprising:
(a) a directional reference means affixed to the housing, and
(b) an underwater writing means for conveying written information to a diver.

6. The utility console according to claim 4 wherein the means for applying a gripping force comprises a handle pivotal between an upright position suitable for gripping and a prone position which presents a minimal handle profile.

7. The utility console according to claim 6 further comprising a recess defined by the framework in which the handle is disposed when it is in its prone position.

8. The utility console according to claim 4 further comprising an inflatable bladder means insertible into the sack means for giving the bag device a positive buoyancy for buoying a thing or things attached to the device, the thing or things being attached to the means for applying the gripping force.

9. The utility console according to claim 4 further comprising means affixed to the housing for providing a diver with ambient water parameters.

10. The utility console according to claim 1 wherein the means for applying a gripping force comprises a handle pivotal between an upright position suitable for gripping and a prone position which presents a minimal handle profile.

11. A utility console according to claim 10 further comprising a recess defined by the framework in which the handle is disposed when it is in its prone position.

12. The utility console according to claim 1 further comprising an inflatable bladder means insertible into the sack means for giving the bag device a positive buoyancy for buoying a thing or things attached to the device, the thing or things being attached to the means for applying the gripping force.

13. The utility console according to claim 1 further comprising means affixed to the housing for providing a diver with ambient water parameters.

* * * * *